US010295191B2

(12) United States Patent
Chin

(10) Patent No.: US 10,295,191 B2
(45) Date of Patent: May 21, 2019

(54) GAS TURBINE ENGINE AND ANNULAR COMBUSTOR WITH SWIRLER

(75) Inventor: Jushan Chin, Irvine, CA (US)

(73) Assignee: ROLLS-ROYCE CORPORATION, Indianapolis, IN (US)

( * ) Notice: Subject to any disclaimer, the term of this patent is extended or adjusted under 35 U.S.C. 154(b) by 1025 days.

(21) Appl. No.: 13/341,941

(22) Filed: Dec. 31, 2011

(65) Prior Publication Data

US 2013/0167546 A1 Jul. 4, 2013

(51) Int. Cl.

| | |
|---|---|
| ***F23R 3/52*** | (2006.01) |
| ***F23R 3/34*** | (2006.01) |
| *F23R 3/10* | (2006.01) |
| *F23R 3/14* | (2006.01) |

(52) U.S. Cl.

CPC ..... *F23R 3/34* (2013.01); *F23R 3/52* (2013.01); *F23R 3/10* (2013.01); *F23R 3/14* (2013.01); *F23R 2900/03341* (2013.01)

(58) Field of Classification Search

CPC ..... F23R 3/52; F23R 3/10; F23R 3/14; F23R 3/20

See application file for complete search history.

(56) References Cited

U.S. PATENT DOCUMENTS

| | | | | |
|---|---|---|---|---|
| 2,855,754 A | | 10/1958 | Giannotti | |
| 4,018,043 A | * | 4/1977 | Clemmens | 60/39.23 |
| 4,151,709 A | | 5/1979 | Melconian et al. | |
| 5,113,647 A | * | 5/1992 | Shekleton | 60/804 |
| 5,174,108 A | * | 12/1992 | Shekleton | F02C 3/05 60/760 |
| 5,197,278 A | * | 3/1993 | Sabla et al. | 60/773 |
| 5,749,219 A | * | 5/1998 | DuBell | 60/804 |
| 5,946,902 A | | 9/1999 | Schutz et al. | |
| 6,192,669 B1 | | 2/2001 | Keller et al. | |
| 6,389,815 B1 | * | 5/2002 | Hura et al. | 60/746 |
| 7,127,897 B2 | | 10/2006 | Carrea | |
| 2002/0069644 A1 | | 7/2002 | Stuttaford et al. | |
| 2005/0155339 A1 | | 7/2005 | Perlo et al. | |
| 2005/0160715 A1 | | 7/2005 | Perlo et al. | |
| 2005/0160737 A1 | | 7/2005 | Perlo et al. | |
| 2006/0236701 A1 | * | 10/2006 | Carrea | 60/776 |

(Continued)

FOREIGN PATENT DOCUMENTS

| | | |
|---|---|---|
| WO | 9001624 | 2/1990 |

OTHER PUBLICATIONS

International Search Report and Written Opinion, PCT/US2012/072234, Rolls-Royce Corporation, Aug. 26, 2013.

*Primary Examiner* — Ehud Gartenberg
*Assistant Examiner* — Thomas Burke
(74) *Attorney, Agent, or Firm* — Brinks Gilson & Lione

(57) ABSTRACT

A combustor is provided in which a fuel and working fluid can be injected in an annulus. In one form the fuel and working fluid is circumferentially flowed within the annulus and traverses the annulus in an axial direction from one side to another side where the flow exits. The working fluid and air can be co-axially admitted to the combustor and in one form the working fluid can be swirled about the fuel dispensed from a fuel injector. The combustor can provide for a rich burning zone. In one embodiment the combustor is configured as an inter-turbine combustor having an outlet at one axial side of the combustor. A lean burn region can be created within a flow path of the turbine.

21 Claims, 7 Drawing Sheets

(56) References Cited

U.S. PATENT DOCUMENTS

| | | | | |
|---|---|---|---|---|
| 2008/0041059 | A1* | 2/2008 | Teets | F23D 14/66 60/737 |
| 2009/0064654 | A1* | 3/2009 | Kirzhner et al. | 60/39.17 |
| 2010/0083664 | A1* | 4/2010 | Mancini | F23R 3/14 60/752 |
| 2010/0257864 | A1* | 10/2010 | Prociw | F02C 3/145 60/758 |
| 2011/0079016 | A1 | 4/2011 | Etemad et al. | |

* cited by examiner

GAS TURBINE ENGINE AND ANNULAR COMBUSTOR WITH SWIRLER

GOVERNMENT RIGHTS

The present application was made with the United States government support under Contract No. F33615-03-D-2300 0003, awarded by the United States Air Force. The United States government has certain rights in the present application.

TECHNICAL FIELD

The present invention generally relates to gas turbine engine combustors, and more particularly, but not exclusively, to annular combustor used in gas turbine engines.

BACKGROUND

Mixing and burning mixtures of fuel and working fluid in gas turbine engine combustors remains an area of interest. Some existing systems have various shortcomings relative to certain applications. Accordingly, there remains a need for further contributions in this area of technology.

SUMMARY

One embodiment of the present invention is a unique combustor for a gas turbine engine. Other embodiments include apparatuses, systems, devices, hardware, methods, and combinations for combusting a mixture of fuel and working fluid as an inter-turbine combustor. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
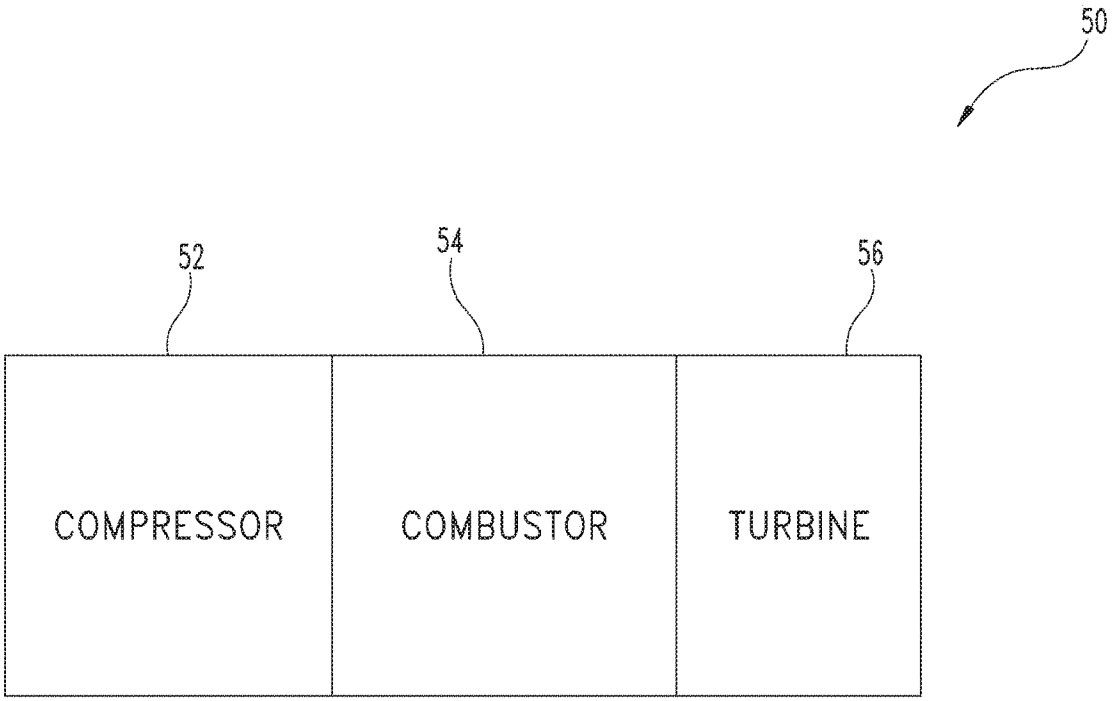
FIG. 1 depicts one embodiment of a gas turbine engine.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, a gas turbine engine 50 is depicted which includes a compressor 52, combustor 54, and turbine 56. The gas turbine engine 50 operates by receiving and compressing a working fluid such as air and delivering the compressed working fluid to the combustor 54. A fuel is mixed and combusted with the compressed working fluid in the combustor 54 which supplies the resultant flow to the turbine 56. Work can be extracted from the resultant flow in the turbine 56, such work useful to turn a shaft that is coupled with the compressor 52. In some embodiments the gas turbine engine 50 can provide power to an aircraft. As used herein, the term "aircraft" includes, but is not limited to, helicopters, airplanes, unmanned space vehicles, fixed wing vehicles, variable wing vehicles, rotary wing vehicles, unmanned combat aerial vehicles, tailless aircraft, hover crafts, and other airborne and/or extraterrestrial (spacecraft) vehicles. Further, the present inventions are contemplated for utilization in other applications that may not be coupled with an aircraft such as, for example, industrial applications, power generation, pumping sets, naval propulsion, weapon systems, security systems, perimeter defense/security systems, and the like known to one of ordinary skill in the art.

Furthermore, the gas turbine engine 50 can take on a variety of forms. For example, the engine 50 can be a turboshaft, turbofan, turboprop, or turbojet engine. In some embodiments the gas turbine engine 50 can be a variable and/or adaptive cycle engine. Though the gas turbine engine 50 is depicted as a single spool engine, other embodiments can include one or more additional spools. Such multi-spool embodiments can include a relatively high pressure spool and a relatively low pressure spool. To set forth just one non-limiting example, in a three spool configuration the gas turbine engine can include an intermediate pressure spool as the relatively low pressure spool compared to the high pressure spool, or the intermediate pressure spool can be a relatively high pressure spool relative to the low pressure spool. Such terms as "relatively high" and "relatively low" will be appreciated as not strictly limited to the high pressure spool and low pressure spool but are rather relative terms to be understood in light of other spools of interest, whether the engine 50 includes two or more spools.

The gas turbine engine 50 can include one or more combustors used throughout the engine. For example, the gas turbine engine 50 can include a combustor disposed between a compressor and turbine, but can also include other types of combustors. In some embodiments the gas turbine engine 50 can also include an inter-turbine combustor used to provide re-heat to a working fluid to be flowed through one or more rows of turbine blades. Such an inter-turbine combustor can have a variety of configurations.

Figure 2:
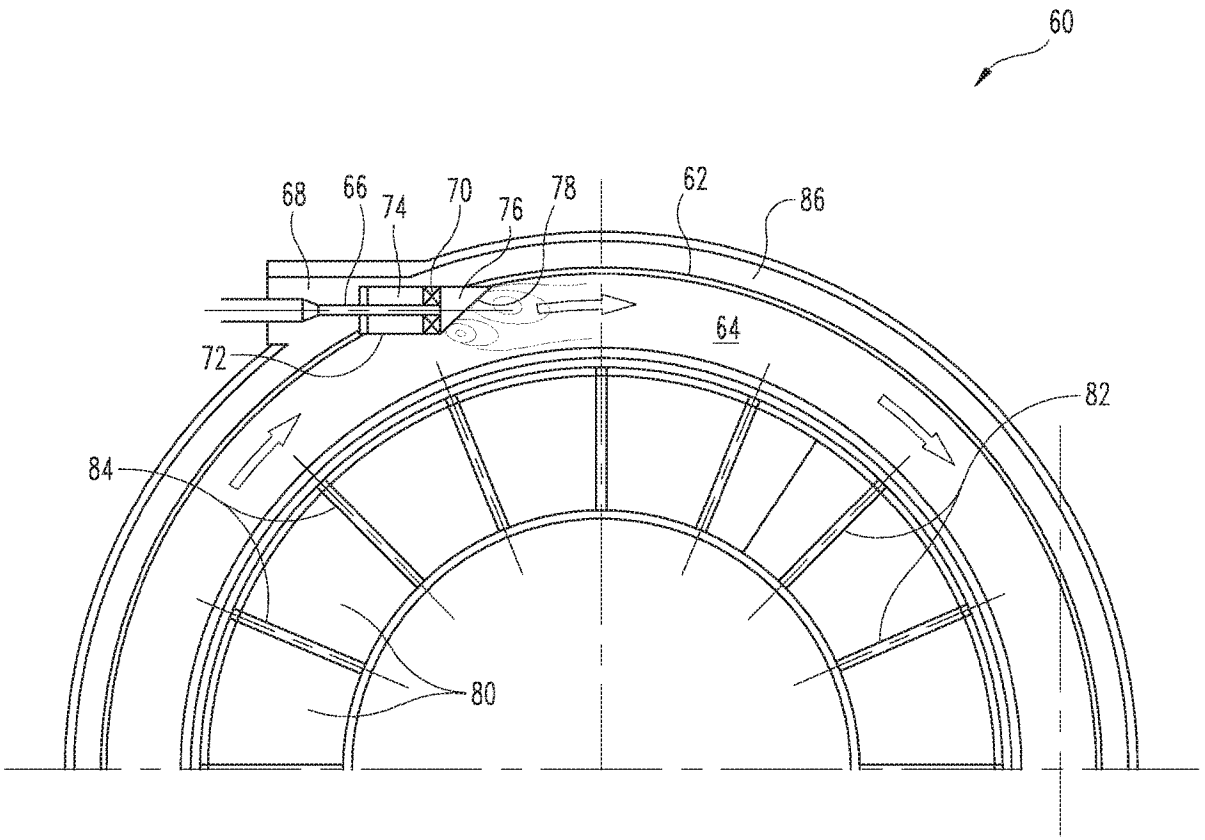
FIG. 2 depicts a view of one embodiment of a combustor.
Figure 3:
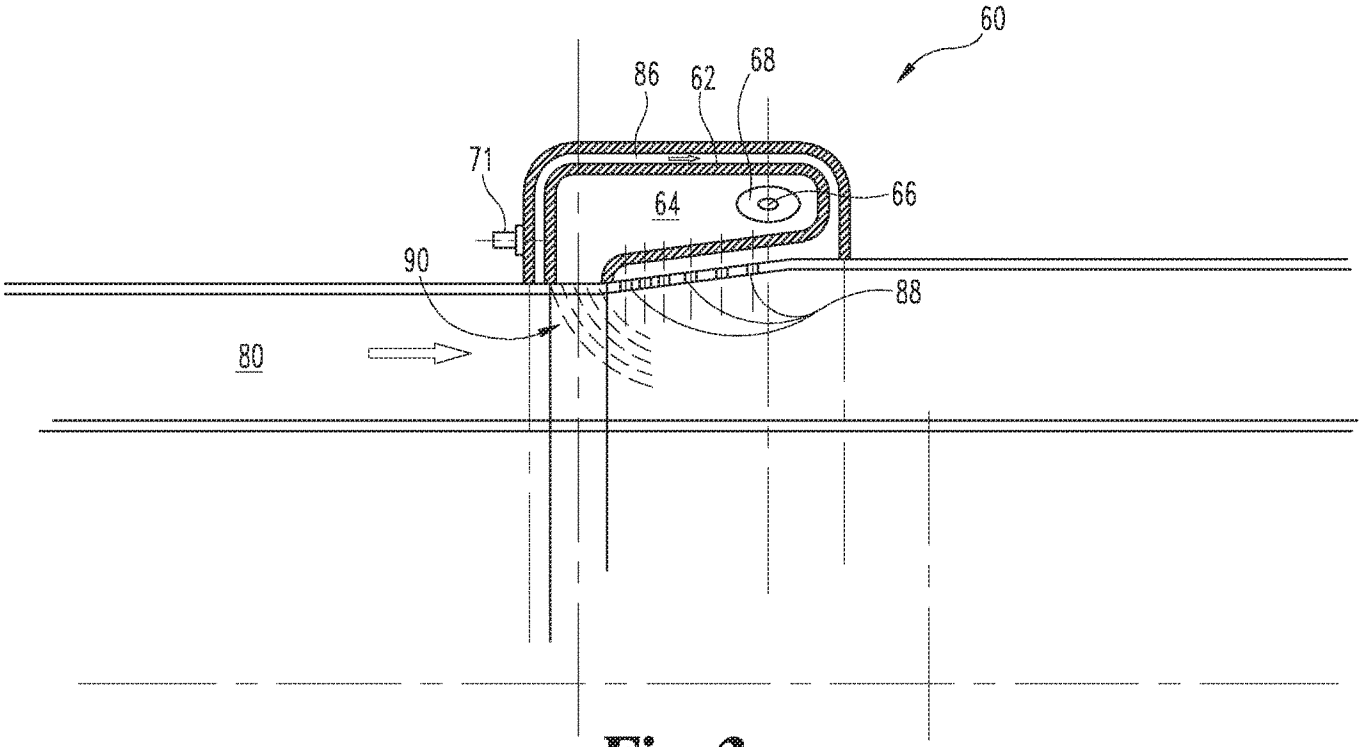
FIG. 3 depicts a view of one embodiment of a combustor.
Figure 7:
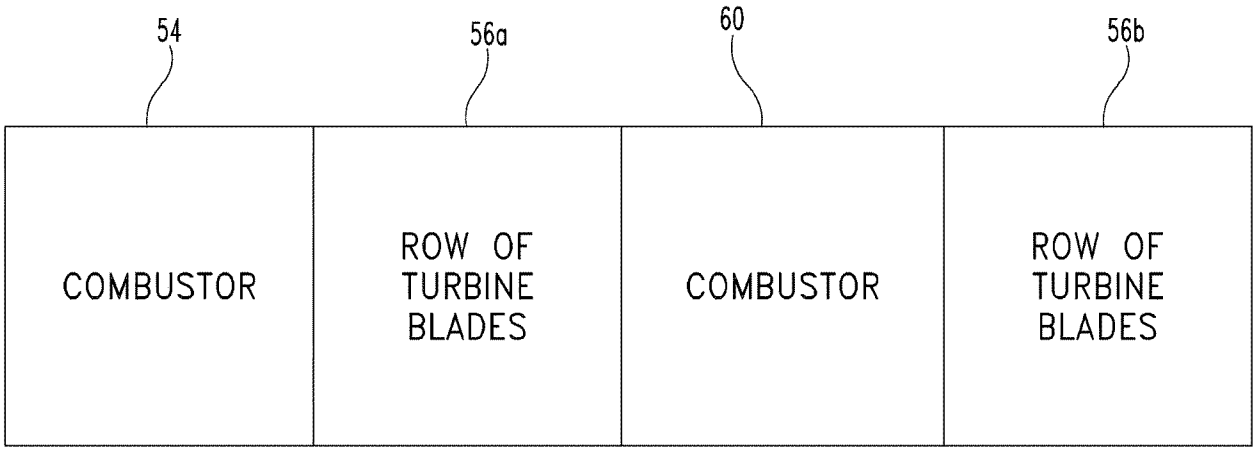
FIG. 7 depicts one embodiment of an inter-turbine combustor.

Turning now to FIGS. 2-3, various embodiments of a combustor 60 used within the gas turbine engine 50 are illustrated and are shown for ease of discussion from various perspectives. In some embodiments of the gas turbine engine the combustor 60 can be used as an inter-turbine combustor. For example, referring to FIG. 7, the combustor 60 can be used between rows of turbine blades **56*a* and 56*b* in the gas turbine engine 50 and downstream of the combustor 54. In some embodiments the combustor 60** can be placed between a relatively high pressure turbine and a relatively low pressure turbine, but other configurations might also be possible. For sake of convenience only, the discussion that follows may make reference to the combustor as an inter-turbine combustor but it will be appreciated that the discussion is not limited strictly to such combustors.

The combustor 60 is arranged to flow a mixture of fuel and working fluid in a circumferential direction around a duct 62. In one form the duct 62 can be annular and can have any variety of cross sectional shapes that at least partially define a combustor passage 64. In one form the duct 62 forms a combustor passage 64 extending entirely around a reference axis, such as a centerline of the gas turbine engine 50. The combustor 60 includes a fuel injector 66 and a working fluid inlet 68. In one form the working fluid inlet 68 can be configured to receive working from through a duct 71. The working fluid inlet 68 can be configured to receive working fluid from a variety of directions. For example, the working fluid can be received in the inlet 68 from a radial or circumferential direction, and in some embodiments a structure can further be used to turn or manipulate the working fluid prior to introduction into the passage 64. The fuel injector 66 can be configured to provide fuel to the combustor at a variety of temperatures, pressures, and flow rates. The fuel can take a variety of forms such as Jet A, Jet B, JP-4, JP-8, synthetic fuels, etc. The fuel injector 66 can be oriented relative to a passing stream of working fluid to provide fuel at a variety of configurations. In the illustrated embodiment the fuel injector 66 provides fuel in a direction relative to an annular combustor passage 64 such that a bulk flow of a passing air and fuel are conveyed to flow in a given circumferential direction about some reference axis. While the illustrated embodiment includes only a single fuel injector 66, other embodiments can include additional injectors.

The working fluid inlet 68 is in flow communication via a passage 64 with a swirler 70 positioned adjacent the fuel injector 66. The swirler 70 is structured to impart movement to a stream of working fluid that interacts with a flow of fuel from the fuel injector 66. The movement imparted to the stream of working fluid can be used to assist in mixing/spreading/shearing/etc. the fuel as it is injected into the combustor 60 by the fuel injector 66. The swirler 70 can take a variety of forms and in one non-limiting embodiment includes vanes that impart a rotational motion to the stream of working fluid. Other configurations of the swirler 70 and/or other devices useful to mix/spread/shear/etc. the fuel with the working fluid.

The fuel injector 66 and passage 74 can protrude into the combustor passage 64 as shown in FIG. 2, but other configurations are also contemplated herein. A member 72 can be used to enclose the passage 74 and in one form is cylindrical in shape. The member 72 or other useful structure can protrude into the combustor passage 64 any variety of distances. A mixing chamber 76 can be disposed downstream of the swirlers 70 as shown in the illustrated embodiment and can have a variety of configurations. The mixing chamber 76 includes an edge 78 that increases in radial height as it progresses circumferentially along the combustor passage 64.

The combustor 60 shown in FIGS. 2 and 3 are located radially outward of a turbine flow path 80 which can include a number of turbine vanes 82. FIG. 2 is shown without turbine blades for ease of illustration. The turbine vanes 82 are depicted as including a turbine cooling space 84 disposed therein. The cooling space 84 can be any suitable space to contain a cooling fluid and in some embodiments can take the form of a cooling passage that extends from one or both of the radially inner and outer walls of the turbine flow path 80. The turbine vanes 82 can include any number of cooling spaces 84 having any variety of configurations.

In some embodiments a combustor cooling space 86 can be located around the combustor 60. The combustor cooling space 86 can be in flow communication with the working fluid inlet 68 as shown in FIG. 2, but in other embodiments the combustor cooling space 86 can receive a cooling fluid from other additional and/or alternative sources. The combustor cooling space 86 can extend around the entirety of the combustor passage 64 as shown in the figures, but other configurations are also contemplated herein. The cooling fluid for either or both of the turbine cooling space 84 and the combustor cooling space 86 can originate from a number of locations. For example, the cooling fluid can be routed from another portion of the gas turbine engine, such as from a location upstream of the vanes 82. In some non-limiting forms the cooling fluid is a diverted working fluid from the turbine 56.

The cooling space 86 can be in flow communication with apertures 88 formed to communicate cooling fluid in the combustor cooling space 86 with the turbine flow path 80. Though multiple apertures 88 are distributed axially along the turbine flow path 80, other configurations are also contemplated. For example, one or more slots can be additionally and/or alternatively used with the apertures 88 to communicate cooling fluid between the cooling space 86 and the turbine flow path 80. In some embodiments apertures 88 may not be present to introduce cooling fluid to the turbine flow path 80. Alternative routings of the cooling fluid may instead be used.

FIG. 3 depicts a view of the combustor passage 64 of the illustrated embodiment shown relative locations of various components. The fuel injector 66 and passage 74 are arranged to deliver fuel and air, or other suitable working fluid, at an axially downstream location relative to the turbine flow path 80 whereupon a flow of the fuel and air travel axially forward as it progresses circumferentially through the passage 64. It will be appreciated in other embodiments that the combustor passage 64 can have configurations different from that depicted in FIG. 3. An igniter 87, pilot, or other suitable energy source can be positioned within or near the combustor passage 64 to encourage combustion of the fuel and working fluid within the passage 64. Combustion can take place in the combustor passage 64 and, depending on the relative amounts of fuel and working fluid, the combustion can be fuel rich within the combustor passage 64.

The embodiment of FIG. 3 includes an outlet 90 structured to deliver the fuel and working fluid, and/or a combusted mixture thereof, to the turbine flow path 80. In the illustrated embodiment the outlet 90 is configured on a radially inner side of the duct 62. The outlet 90 can be axially offset from the fuel injector and working fluid inlet to the duct 62. In the illustrated embodiment the outlet 90 is located, relative to the turbine flow path 80, upstream of the fuel injector 66 and working fluid inlet 68. The duct 62 can include any number of outlets 90. The outlets 90, furthermore, can have any variety of sizes and shapes and can be distributed at a variety of locations. Combinations of sizes, shapes, and/or locations can be used in any given embodiment of the duct 62.

In some embodiments and/or modes of operation a combustion of a fuel and working fluid can occur within the turbine flow path 80. For example, a quick quenching can occur when a fuel and working fluid, its combustion, and products of combustion, enter and mix with working fluid traversing the turbine flow path 80. In some cases the combustion process that occurs within the path 80 can be fuel lean. The combustion that occurs in the turbine flow path 80 can take place at any variety of radial locations within the flow path 80.

The turbine vanes 82 positioned in the flow path 80 can be located in a number of positions relative to the outlet 90 of the duct 62. For example, the vanes 82 can be located either upstream or downstream of the outlet 90. In some embodiments rows of vanes 82 can be located both upstream and downstream of the outlet 90, in which case the vane rows can have similarly configured vanes 82, such as whether cooling passages are disposed therein or not. In some embodiments rows of vanes 82 positioned on either side of the outlet 90 can be configured differently.

Figure 4:
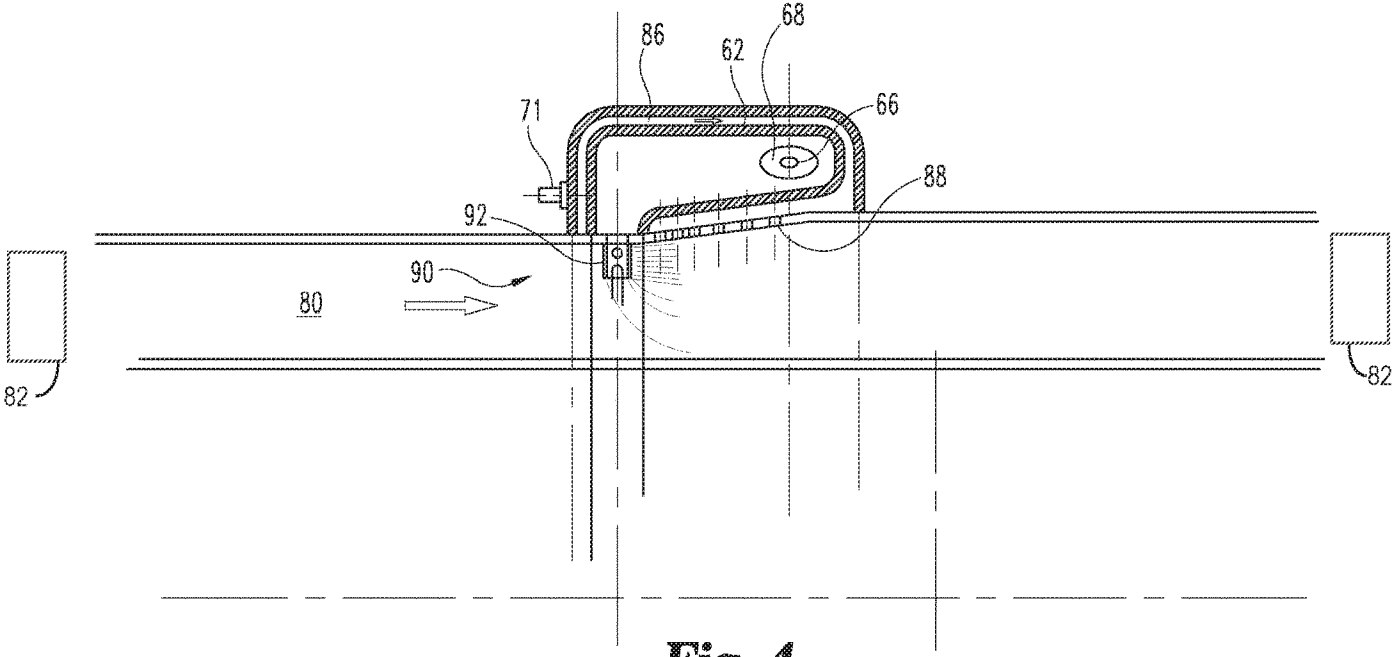
FIG. 4 depicts a view of one embodiment of a combustor.
Figure 5:
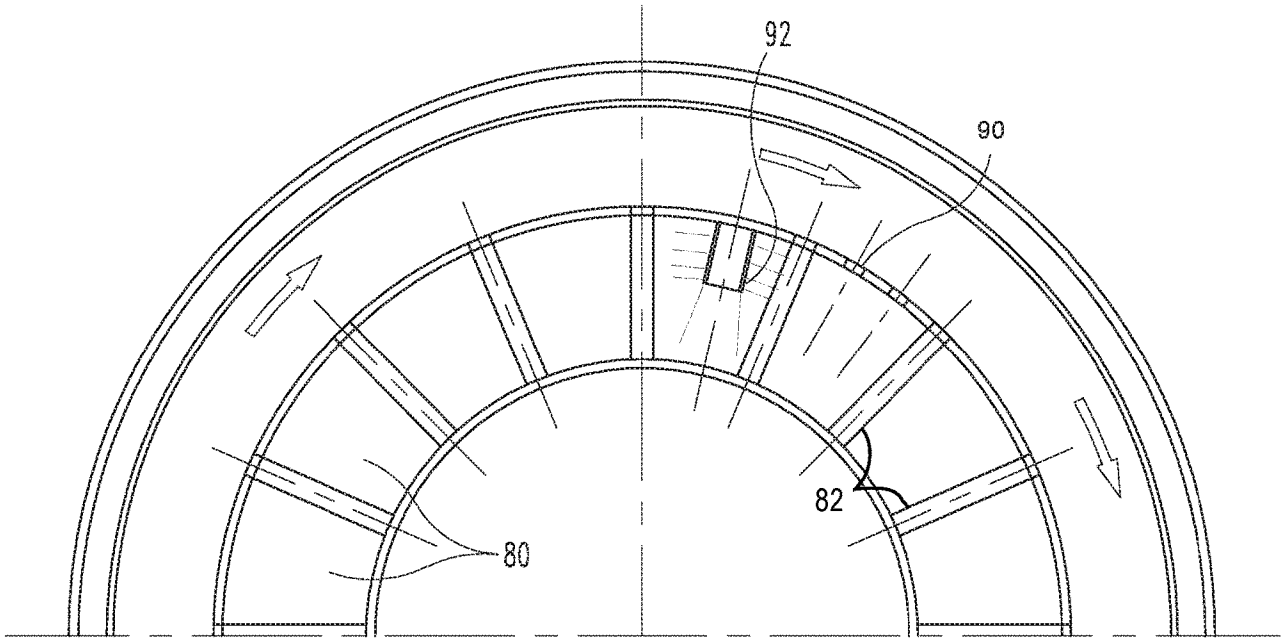
FIG. 5 depicts a view of one embodiment of a combustor.

FIGS. 4 and 5 depict another embodiment of the combustor 60 in which the duct 62 is in fluid communication with one or more outlet passages 92 that extend from the outlet 90 into the turbine path 80. In one form the outlet passages 92 are shaped as tubes having a central passage that is in fluid communication with the duct 62, but the outlet passages 92 can take on a variety of other shapes as well. The outlet passages 92 can be oriented such that they radially project from the duct 62 any variety of distance away from the duct 62. For example, the outlet passages 92 can project a variety of distances relative to an opposing wall of a turbine flow path 80 within which is located turbine blades and/or vanes 82. Any number of outlet passages 92 can be used.

The outlet passages 92 can have any variety of configuration. In one form the outlet passages 92 can have holes and/or slots formed therein. Any number of holes and/or slots can be used in the outlet passages 92. In addition, any given outlet passages 92 can have a combination of holes and slots. The outlet passages 92 used in the combustor 60 can be similar in configuration, but some embodiments of the combustor 60 can include any variety of different outlet passages 92 configurations. For example, some outlet passages 92 can have holes, others can include slots, while still others includes a combination of holes and slots.

As shown in FIG. 5, some embodiments of the combustor 60 can include a combination of outlet passages 92 as well as outlets 90. The outlets 90 can have a larger cross sectional area than the outlet passages 92, but in some embodiments the cross sectional area can be smaller than or the same. While the embodiment in FIG. 5 shows a combination of outlets 90 and outlet passages 92, some embodiments of the combustor 60 can include exclusively either outlets 90 or outlet passages 92.

Figure 6:
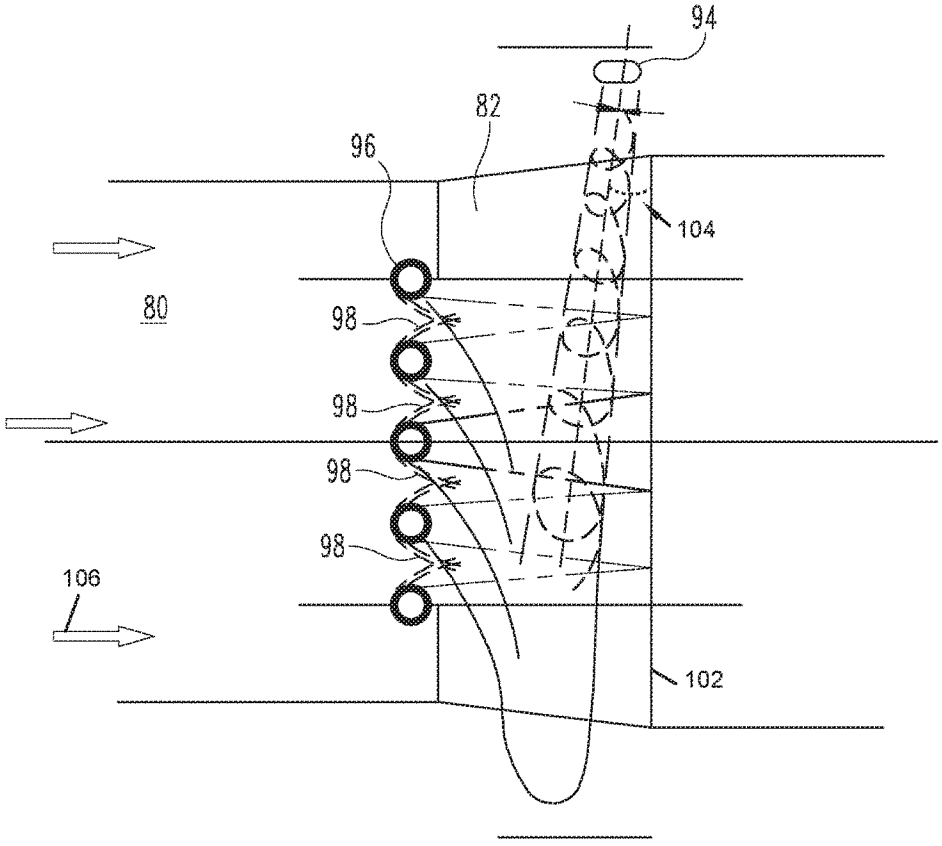
FIG. 6 depicts a view of one embodiment of a combustor.

Turning now to FIG. 6, a view of the combustor is shown from a generally radial direction and in which some detailed has been removed for purposes of illustration. A flow of fuel and working fluid is shown entering the duct 62 near the top of the figure and is shown flowing toward the bottom of the figure. The flow of fuel and working fluid is directed in the circumferential direction and is angled relative to a reference line by about between 3-4 degrees. The reference line can be representative of a line normal to a centerline of the gas turbine engine 50. Other angles of the flow of fuel and working fluid can also be used. In addition, though not depicted the flow of fuel and working fluid can also be angled relative to a line, such as the centerline, to provide a radial component. The figure depicts a swirling type motion as the fuel and working fluid flow away from a point 94 which can be representative of an exit of the fuel injector 66 or an exit of the swirlers 70. As will be appreciated by continuing reference to the prior figures, as the fuel and working fluid move circumferentially through the duct 62 the flow moves toward an exit 96 and into the turbine flow path 80. The exit 96 can be representative of the outlets 90 and/or outlet passages 92, which can but need not take the cross sectional form depicted in the illustrated embodiment. As the flow of fuel and working fluid, or a combustion process thereof, approaches the axially forward portion of the duct 62 it flows through the exit 96 and into the turbine flow path 80 where it encounters a flow of working fluid. Lines 98 can represent a front as the flow of fuel and working fluid from the duct 62, and/or a flame front of a combustion occurring in the turbine flow path 80, encounters a flow of working fluid in the flow path 80.

It will be appreciated that the combustor 60 described above can take on a variety of configurations. In one non-limiting embodiment the combustor 60 can include dimensions as follows. The combustor 60 can be approximately 2.1 inches from an axial forward side of a housing enclosing the combustor 60 to an axially aft side of the housing. A dimension from the axially forward side of the housing to an axially aft side of the exit 90 can be 0.43 inches. A dimension from the axially aft side of the exit 90 to a center of the fuel injector can be approximately 1.16 inches. And a dimension from the center of the fuel injector to the axially aft side of the housing enclosing the combustor 60 can be approximately 0.51 inches.

One aspect of the present application provides an apparatus comprising a gas turbine engine combustor having an annulus for a combustion of a fuel and working fluid mixture, the combustor having a fuel injector oriented circumferentially relative to the annulus and positioned adjacent a working fluid inlet having vanes structured to swirl the working fluid, the inlet and injector located axially offset from an outlet of the annulus.

One feature of the present application provides a cooling space arranged around the combustor, and wherein the fuel injector is disposed within a circumferential flow path of the working fluid provided via the working fluid inlet.

Another feature of the present application provides a gas turbine engine having a compressor in fluid communication with main combustor and a turbine, the gas turbine engine combustor in the form of an inter-turbine combustor, the turbine having a vane positioned downstream of the outlet from the inter-turbine combustor, and wherein the vane is in fluid communication with the cooling space arranged around the inter-turbine combustor.

Yet another feature of the present application provides wherein the annulus of the combustor surrounds a turbine annulus in which an airfoil member is disposed, and wherein the turbine annulus is capable of flowing a stream of working fluid from an upstream area to a downstream area, and wherein the outlet of the combustor is upstream from the fuel injector.

A further feature of the present application provides wherein the fuel injector is angled relative to a radial plane 102 to produce a swirling flow around a circumference of the gas turbine engine combustor.

A still further feature of the present application provides wherein the fuel injector is angled between about 3-4 degrees 104 from a radial plane 102.

Yet a still further feature of the present application provides wherein the fuel injector is positioned toward a first end of the annulus and which further includes an igniter positioned toward a second end of the annulus such that a swirling motion of a fuel and working fluid mixture traverses the annulus in a circumferential motion before ignition.

Still yet another feature of the present application provides wherein the outlet includes a plurality of outlets having tubes that extend therefrom.

Another aspect of the present application provides an apparatus comprising a gas turbine engine including an annular turbine flow path in which a rotatable turbine blade row is disposed, and an inter-turbine combustor having a toroidal construction that is radially offset from the annular turbine flow path of the gas turbine engine, the inter-turbine combustor including a coaxial air inlet and fuel dispenser, wherein the inter-turbine combustor includes an outlet to the annular turbine flow path between rows of turbine blades.

A feature of the present application provides wherein the toroidal construction extends axially between a first axial side and a second axial side, and wherein the outlet of the inter-turbine combustor is disposed toward the first axial side.

Another feature of the present application provides wherein the coaxial fuel dispenser and air inlet are structured to swirl a mixture of fuel and air along a circumferential direction within the toroidal construction.

Yet another feature of the present application provides wherein the fuel dispenser and air inlet are disposed toward the second axial side, the second axial side located downstream of the first axial side relative to the annular turbine flow path.

Still another feature of the present application further includes an elongate member having a central passage extending from the outlet into the annular turbine flow path.

Still yet another feature of the present application provides wherein the fuel dispenser and air inlet provide a fuel rich mixture for combustion within the inter-turbine combustor, and which further includes a tube extending from the outlet and having an opening formed in its surface in communication with a central passage of the tube.

A further feature of the present application further includes a cooling space outside of the inter-turbine combustor that is in fluid flow communication with a vane disposed in the annular turbine flow path downstream of an outlet of the inter-turbine combustor.

A still further feature of the present application provides wherein the outlet of the inter-turbine combustor is located between a relatively high pressure turbine and a relatively low pressure turbine, and wherein the outlet includes a tube extending therefrom.

A further aspect of the present application provides an apparatus comprising a gas turbine engine having a working fluid flow path through a compressor, combustor, and turbine, an annular flow space offset from the working fluid flow path and structured to circumferentially flow a mixture of fuel and working fluid around the working fluid flow path, the annular flow space including an igniter for combustion of the mixture, and means for circumferentially spiraling the mixture of fuel and working fluid to increase residence time within the annular flow space.

A feature of the present application provides wherein the means includes means for swirling a working fluid around a fuel injector.

A still further aspect of the present application provides a method comprising operating a gas turbine engine having a row of rotating turbine blades disposed in a working fluid annulus, circumferentially injecting a working fluid and fuel into an annular combustor, conveying the circumferentially injected working fluid and fuel in an axial direction extending from a first axial side of the annular combustor to a second axial side of the annular combustor, combusting the mixture of working fluid and fuel, and passing a combustion flow to the working fluid annulus through an exit.

A feature of the present application provides wherein the fuel and working fluid are coaxially injected, wherein the passing includes radially flowing the combustion flow into the working fluid annulus, and wherein the combusting occurs axially offset from the circumferentially injecting.

Another feature of the present application further includes combusting a rich mixture of working fluid and fuel within the annular combustor.

Yet another feature of the present application provides the conveying progressing in a direction opposite a direction 106 of working fluid in the working fluid annulus.

Still yet another feature of the present application further includes turning a flow of combustion from a first direction to a second direction and exiting the exit of the annular combustor.

A further feature of the present application provides wherein the circumferentially injecting includes swirling a working fluid around an injection of fuel, the circumferentially injecting arranged at an angle to a vertical plane.

Still a further feature of the present application further includes transiting the flow of combustion through a passage that extends into the working fluid annulus.

Yet still a further feature of the present application further includes cooling a wall of the annular combustor with a working fluid, the working fluid routed to a turbine vane subsequent the cooling.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising:

a gas inter-turbine engine combustor having an annular duct defining a combustor passage extending annularly around a centerline of a gas turbine engine, the centerline of the gas turbine engine parallel to an annular turbine flow path of the gas turbine engine, a working fluid inlet positioned on a radially outward side of the annular duct relative to the centerline of the gas turbine engine, and an outlet positioned on a radially inner side of the combustor passage relative to the centerline of the gas turbine engine, wherein the working fluid inlet is configured to swirl a working fluid as the working fluid passes through the working fluid inlet; and a fuel injector positioned on a radially outer side of the annular duct relative to the centerline of the gas turbine engine within the working fluid inlet, wherein the fuel injector is angled relative to a radial plane such that a mixture of fuel and working fluid is conveyed to flow circumferentially about the combustor passage from an exit of the fuel injector and toward the outlet, wherein the outlet is in a shape of a tube that radially extends away from the combustor passage and projects into the annular turbine flow path from a wall that at least partially defines the annular turbine flow path, wherein the tube is positioned in the annular turbine fluid flow path upstream from a first row of turbine blades and downstream from a second row of turbine blades.

2. The apparatus of claim 1, which further includes a cooling space arranged around the gas inter-turbine engine combustor, and wherein the fuel injector is disposed within a circumferential flow path of the working fluid provided via the working fluid inlet.

3. The apparatus of claim 1, wherein the fuel injector is angled between about 3-4 degrees from the radial plane.

4. The apparatus of claim 1, wherein the fuel injector is positioned toward a first end of the combustor passage and which further includes an igniter positioned toward a second end of the combustor passage such that a swirling motion of a fuel and working fluid mixture traverses the combustor passage in a circumferential motion for ignition.

5. An apparatus comprising:

a gas turbine engine including a working fluid annulus that defines an annular turbine flow path in which rows of rotatable turbine blades are disposed; and an inter-turbine combustor having a toroidal construction defining a combustor passage extending annularly around a centerline of the gas turbine engine and that is radially offset from the annular turbine flow path of the gas turbine engine, the combustor passage including an air inlet disposed on a radially outward side of the toroidal construction relative to the centerline of the gas turbine engine, the combustor passage further including a fuel dispenser coaxial with the air inlet, the fuel dispenser is angled, relative to a radial plane, toward an outlet defined on a radially inward side of the toroidal construction, wherein the outlet is upstream, relative to the annular turbine flow path, from the air inlet and fuel dispenser and the outlet opens into an elongated member that radially extends from the inter-turbine combustor and through a wall of the working fluid annulus that at least partially defines the annular turbine flow path, wherein the elongated member projects into the annular turbine flow path from the wall and is positioned between the rows of rotatable turbine blades.

6. The apparatus of claim 5, wherein the toroidal construction extends axially between a first axial side and a second axial side, and wherein the outlet of the combustor passage is disposed toward the first axial side.

7. The apparatus of claim 6, wherein the fuel dispenser and air inlet are structured to swirl a mixture of fuel and air along a circumferential direction within the combustor passage toward the outlet.

8. The apparatus of claim 7, wherein the fuel dispenser and air inlet are disposed toward the second axial side, the second axial side located downstream of the first axial side relative to the annular turbine flow path.

9. The apparatus of claim 5, wherein the fuel dispenser and air inlet provide a fuel rich mixture for combustion within the combustor passage, and which further includes a tube extending from the outlet, wherein a surface of the tube defines an opening in communication with a central passage of the tube.

10. The apparatus of claim 5, which further includes a cooling space outside of the inter-turbine combustor that is in fluid flow communication with a turbine vane disposed in the annular turbine flow path downstream of an outlet of the inter-turbine combustor.

11. The apparatus of 10, wherein the outlet of the inter-turbine combustor is located between a relatively high pressure turbine and a relatively low pressure turbine.

12. An apparatus comprising:

a gas turbine engine having a center line and a working fluid flow path through a compressor, combustor, and turbine having rows of turbine blades;

a combustion passage defined by an annular duct extending annularly around the center line and radially offset from the working fluid flow path and structured to circumferentially flow a mixture of fuel and working fluid around the working fluid flow path, the combustion passage including an igniter for combustion of the mixture of fuel and working fluid and an outlet defined on a radially inner side of the annular duct;

a working fluid inlet positioned on a radially outer side of the annular duct relative to the center line;

a fuel injector coaxial with the working fluid inlet configured to provide fuel for the working fluid, the fuel injector being positioned in the working fluid inlet;

a swirler positioned adjacent the fuel injector such that the working fluid is mixed with fuel from the fuel injector and conveyed from an exit of the swirler and along a circumferential direction about the combustion passage; and an elongated member in fluid communication with the outlet positioned on the radially inner side of the annular duct, the elongated member projecting into the working fluid flow path from a wall that at least partially defines the working fluid flow path, wherein the elongated member is positioned between the rows of turbine blades.

13. The apparatus of claim 12, wherein the swirler includes a means for swirling the working fluid around the fuel injector.

14. A method comprising:

operating a gas turbine engine having rows of rotating turbine blades disposed in a working fluid annulus;

circumferentially injecting, relative to a center line of the gas turbine engine, a working fluid and fuel into a first axial side of a combustion passage defined by an annular duct from a working fluid inlet and a fuel injector coaxial with the working fluid inlet, the working fluid inlet and the fuel injector positioned on a radially outer side of the annular duct relative to the center line, and oriented circumferentially relative to the center line, wherein the fuel injector is angled relative to a radial plane;

conveying the circumferentially injected working fluid and fuel in an upstream direction, relative to the working fluid annulus of the gas turbine engine, from an exit of a swirler adjacent to the fuel injector, toward a tubular outlet that extends into the working fluid annulus from a radially inner side of the annular duct at a second axial side of the combustion passage;

combusting a mixture of working fluid and fuel; and passing a combustion flow through at least a portion of the tubular outlet that projects into the working fluid annulus from a wall that at least partially defines the working fluid annulus, the combustion flow being received by the working fluid annulus at a position between the rows of rotating turbine blades.

15. The method of claim 14, wherein the fuel and working fluid are coaxially injected, wherein the passing includes radially flowing the combustion flow into the working fluid annulus, and wherein the combusting occurs axially offset from the circumferentially injecting.

16. The method of claim 14, which further includes combusting a rich mixture of working fluid and fuel within the combustion passage.

17. The method of claim 14, which further includes turning a flow of combustion from a first direction in the combustion passage to a second direction in the working fluid annulus.

18. The method of claim 14, wherein the circumferentially injecting includes swirling the working fluid around an injection of fuel, the circumferentially injecting arranged at an angle to a vertical plane.

19. The method of claim 14, which further includes cooling a wall of the annular duct with a working fluid, the working fluid routed to a turbine vane subsequent the cooling.

20. The apparatus of claim 1, where the tube is positioned in the turbine flow path upstream from the row of turbine vanes.

21. The apparatus of claim 2, wherein the annular duct includes an aperture in fluid communication with the cooling space and with the turbine flow path, wherein the aperture is downstream from the outlet, relative to the turbine flow path.

* * * * *